United States Patent [19]

Figgins et al.

[11] Patent Number: 4,666,585

[45] Date of Patent: May 19, 1987

[54] DISPOSAL OF PETROLEUM SLUDGE

[75] Inventors: Dale A. Figgins, Homewood; J. Jay Grove, Alsip, both of Ill.

[73] Assignee: Atlantic Richfield Company, Plano, Tex.

[21] Appl. No.: 764,451

[22] Filed: Aug. 12, 1985

[51] Int. Cl.[4] ..... C10G 9/14; C10G 17/00

[52] U.S. Cl. ..... 208/131; 208/13; 585/240

[58] Field of Search ..... 208/13, 131

[56] References Cited

U.S. PATENT DOCUMENTS

| | | | |
|---|---|---|---|
| 1,697,264 | 1/1929 | Ellis | 208/14 |
| 1,975,131 | 10/1934 | Thompson et al. | 208/13 |
| 2,043,646 | 6/1936 | Bahlke | 208/13 |
| 2,191,486 | 2/1940 | Karrer et al. | 208/14 |
| 3,146,185 | 8/1964 | Fella | 208/131 |
| 3,498,906 | 3/1970 | Bogart et al. | 208/131 |
| 3,917,564 | 11/1975 | Meyers | 208/131 |
| 4,014,661 | 3/1977 | Hess et al. | 208/131 |
| 4,552,649 | 11/1985 | Patterson et al. | 208/13 |

OTHER PUBLICATIONS

Disposal of Acid Sludge, Petroleum Age including Petroleum, vol. 12, No. 8, by Kauffman.

*Primary Examiner*—John Doll
*Assistant Examiner*—Helane Wyers
*Attorney, Agent, or Firm*—James C. Fails; F. Lindsey Scott

[57] ABSTRACT

A process for producing delayed petroleum coke wherein petroleum sludge is added to liquid hydrocarbon coker feedstock.

3 Claims, 1 Drawing Figure

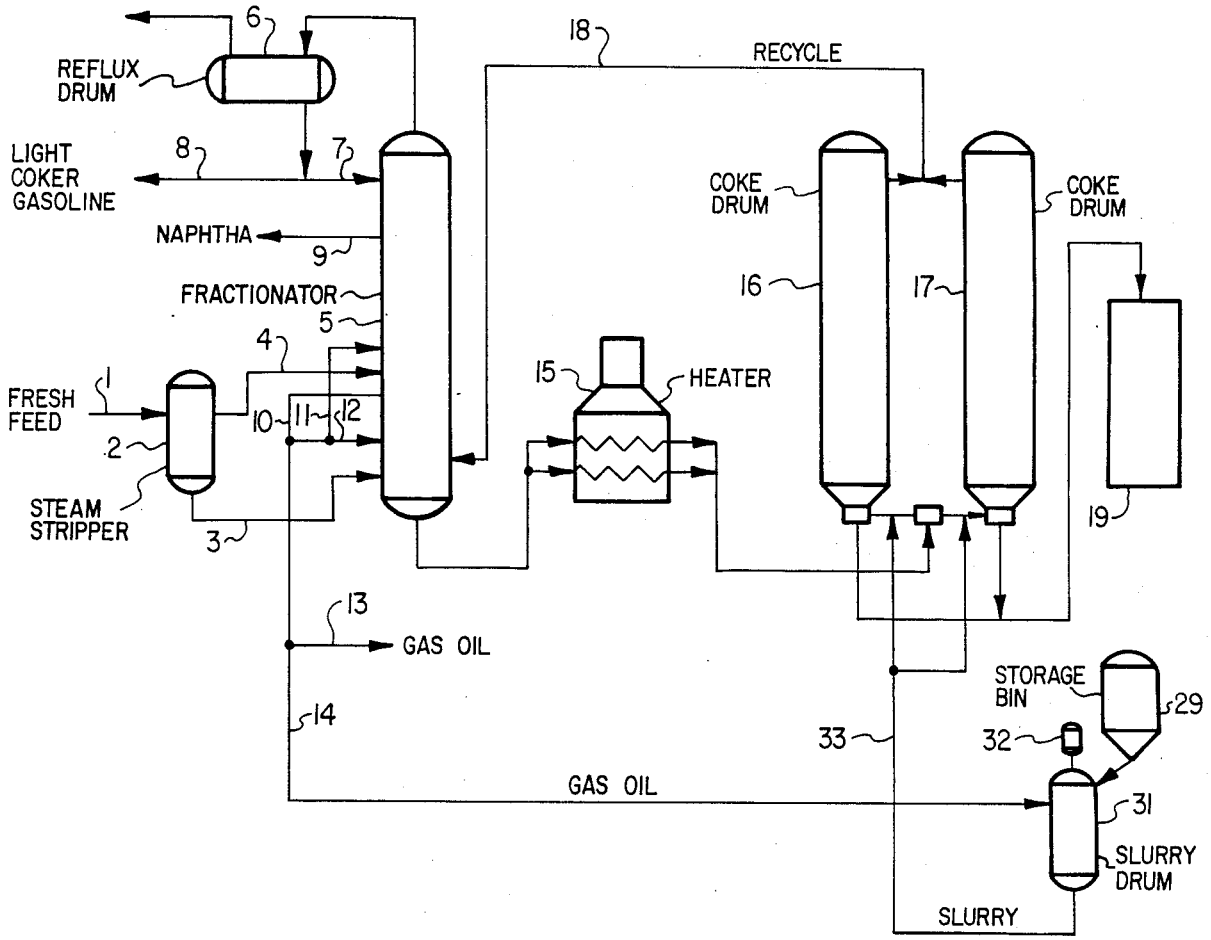
6
REFLUX DRUM
18
RECYCLE
LIGHT COKER GASOLINE
8
7
COKE DRUM
COKE DRUM
NAPHTHA
9
FRACTIONATOR
5
16
17
4
15
HEATER
FRESH FEED
1
10
11
12
2
STEAM STRIPPER
3
19
13
GAS OIL
STORAGE BIN
29
14
33
32
GAS OIL
31
SLURRY DRUM
SLURRY

DISPOSAL OF PETROLEUM SLUDGE

BACKGROUND OF THE INVENTION

1. Field of the Invention

This invention is concerned with (1) delayed coking of heavy petroleum fractions and (2) disposal of petroleum sludge.

2. The Prior Art

Delayed coking has been practiced for many years. The process broadly involves thermal cracking of heavy liquid hydrocarbons to produce gas, liquid streams of various boiling ranges, and coke.

In the delayed coking process, a petroleum fraction is heated to coking temperatures and then fed into a coke drum under conditions which initiate thermal cracking. Following the cracking off of lighter constituents, polymerization of the aromatic structures occurs, depositing a porous coke mass in the drum.

In the usual application of the delayed coking process, residual oil is heated by exchanging heat with the liquid products from the process and is fed into a fractionating tower where any light products which might remain in the residual oil are distilled out. The oil is then pumped through a furnace where it is heated to the required coking temperature and discharged into the bottom of the coke drum. The oil undergoes thermal cracking and polymerization for an extended period resulting in the production of hydrocarbon vapors that leave the top of the drum and porous carbonaceous coke that remains in the drum. The vapors are then returned to the fractionation tower where they are fractionated into the desired cuts. This process is continued until the drum is substantially full of porous coke. Residual oil feed is then switched to a second parallel drum, while steam is introduced through the bottom inlet of the first drum to quench the coke. The steam strips out the oil present in the drum that was not cracked. During the early stage of steaming, the mixture of water and oil vapors continues to pass to product recovery as during the coking stage. Thereafter, the effluent from steaming is diverted to blow-down facilities in which it is condensed and transferred to settling basins where oil is skimmed from the surface of the water.

After steam cooling to about 700°–750° F., water is introduced to the bottom of the coke drum to complete the quench. The first portions of water are, of course, vaporized by the hot coke. The resultant steam plus oil vapor is passed to blow-down for condensation and skimming to separate oil. Water addition is continued until the drum is completely filled with water. For a period thereafter, water is introduced to overflow the drum with effluent sent to settling equipment for removal of entrained oil, etc.

The water settling system also receives water from other operations in the coker facility as later described. The clarified water so obtained provides the water for quench and for recovery of coke from the drum. Coke recovery proceeds by removal of top and bottom heads from the drum and cutting of the coke by hydraulic jets. First, a vertical pilot hole is drilled through the mass of coke to provide a channel for coke discharge through the bottom opening. Then a hydraulic jet is directed against the upper surface of the coke at a distance from the central discharge bore, cutting the coke into pieces which drop out of the coke drum through the pilot hole.

The cutting jet is moved in both a circular and a vertical direction until the coke bed is completely removed.

The coke so cut from the drum appears in sizes ranging from large lumps to fine particles. To a considerable extent, the fines are separated from the larger pieces as the coke discharges into slotted bins or hopper cars with the water draining off through the slots. This dispersion of fines in water is handled to recover the fines as solid fuel, and the water returns to the system for use in quenching and cutting.

In several stages in the course of the above process, oil and coke are separated from water. A byproduct of this process is petroleum sludge—a mixture of water, oil, coke fines and other materials. Petroleum sludge is also produced in other parts of the refinery during operations such as heat exchanger and storage tank cleaning, and in the bottom of the API separator. This petroleum sludge is extremely difficult to convert into innocuous or useful (recycled) substances at reasonable cost.

Finely divided solids in liquids produce very stable dispersions and are also very effective stabilizers for liquid/liquid dispersions. Dewatering techniques are known for concentrating the sludge, but these are expensive and, at best, leave a concentrated sludge of high water content.

Petroleum refinery sludges are dispersions of oil and water having greatly different proportions of the two immiscible liquids stabilized by finely divided solids such as silt, sand, rust, high carbon content combustibles, and the like. Such dispersions are not readily susceptible to emulsion breaking techniques.

These and other sludges have been subjected to various disposal techniques at considerable expense and less than uniform satisfaction. Incineration of waste containing substantial amounts of water requires elaborate and expensive equipment. The necessary washing of incinerator stack gases has the result that the end product is still a dispersion of solids in water (i.e, a sludge).

"Land farming" is a technique for working sludge into land to permit final disposal by the slow process of bacterial action. Often, this technique is not environmentally acceptable.

Another disposal approach disclosed in U.S. Pat. No. 3,917,564 to Meyers involves mixing petroleum sludge with water and using the resulting mixture to quench the coke in the delayed coking process. While this procedure may be acceptable for producing a fuel grade coke, it is not at all clear that such a procedure would provide a green coke product suitable for providing an acceptable calcined coke product.

A very desirable process would provide an environmentally acceptable manner of disposing of petroleum sludge in a delayed coking process, while recovering the hydrocarbon liquids from the sludge, and producing a green coke suitable for making acceptable calcined coke.

SUMMARY OF THE INVENTION

In summary, this invention provides a delayed coking process wherein hydrocarbon coker feedstock material is heated at coking temperatures in a furnace and then passed to a coke drum where delayed coke is formed and wherein overhead vapors from the coke drum are recovered, characterized in that petroleum sludge is added to said hydrocarbon coker feedstock. As will be appreciated, adding the petroleum sludge to the coker feedstock is before quenching such that the feedstock and the sludge are subjected to delayed coking conditions before quenching.

BRIEF DESCRIPTION OF THE DRAWINGS

FIG. 1 is a schematic flow diagram illustrating the process of the invention.

DESCRIPTION OF THE PREFERRED EMBODIMENT

Broadly stated, this invention is a process for producing petroleum coke which comprises subjecting a heavy petroleum residuum containing petroleum sludge to coking conditions of temperature and pressure. One preferred embodiment consists of slurrying the petroleum sludge in a suitable oil and delivering the slurry to the coke drum.

Any suitable oil can be used for forming an initial petroleum sludge slurry. Normally, a very suitable oil will be one of the oil streams available from the coking unit. While the residual oil feed to the unit is appropriate, it is preferred to use gas oil to form an initial slurry.

Engineering factors determine the proper point for injecting the petroleum sludge slurry into a given delayed coking unit. The more important locations to be considered for injecting the slurry are:

(1) directly into the coke drum either with or without prior heating;

(2) into the furnace feed line; or (3) into the coke drum feed line.

Of those cited above, the preferred location for adding the petroleum sludge slurry is into the coke drum feed line.

Selection of suitable charge stocks for coking operations is well known in the art. The principal charge stocks are high boiling virgin or cracked petroleum residua such as: virgin reduced crude; bottoms from the vacuum distillation of reduced crudes, hereinafter referred to as vacuum reduced residuum; Duo-sol extract; thermal tar; and other heavy residua. Blends of these materials can also be employed.

As indicated above, the preferred coking process is the well known delayed coking process. In this process, which is one of the most commonly-used and most economical at the present time, the charge stock is pumped at about 150 to about 500 psi into a furnace where it is preheated to about 850° to about 950° F. and then discharged into a vertical coking drum through an inlet at the base. The pressure in the drum is maintained at from about 20 to about 80 psi. The drum is well insulated to minimize heat loss, so that a reaction temperature of about 800° to about 900° F. is maintained. The hot charge stock is thermally cracked over a period of several hours, producing valuable hydrocarbon vapors and a porous coke mass.

The preferred mode of operation is illustrated in FIG. 1. The fresh feed from line 1 is stripped in steam stripper 2 in which the feed is split into two streams 3 and 4 which are introduced into the bottom section of fractionator 5. The overhead from the fractionator 5 is cooled at about 300° F. and passed to reflux drum 6, and a portion of the light coker gasoline therefrom is recovered through line 8. Naphtha is removed through line 9, a portion thereof being refluxed (not shown) from a naphtha stripper (not shown), if desired. Gas oil is removed from the fractionator 5 through line 10 and portions thereof are refluxed by means of lines 11 and 12. The bulk of the remainder of the gas oil is removed at 13, but a small quantity from line 14 is used to form a slurry of petroleum sludge for injection into the coker, as will be described hereinafter. The bottoms from the fractionator 5 are passed through heater 15 at about 550° F. and then into one or the other of coke drums 16 and 17 at a temperature of about 910° F. at the beginning of the coke run and about 925° F. at the end of the run. The coke drum overhead vapor is recycled to the fractionator 5 at about 830° F. and about 30 psig through line 18.

Petroleum sludge from storage bin 29 is fed to slurry drum 31 which is equipped with a propeller-type agitator driven by motor 32. Gas oil from the fractionator 5 is used to form a slurry of petroleum sludge which is fed through line 33 directly to the particular coke drum being charged. The slurry is preferably maintained at from about 0.01 to 2 percent by weight petroleum sludge.

When the first coke drum is substantially full, feed is switched to the second parallel coke drum. The coke in the first drum is then cooled and removed from the drum by means of high impact-producing water jets. After the raw coke is dewatered, it is then crushed and screened, and is then passed to raw coke storage silo 19.

The coking operations thus described (except the above reference to the use of petroleum sludge) comprise the standard coking process known as delayed coking, and no claim to novelty is made thereto.

The following example illustrates this invention, it being understood that it is not intended to limit the scope of this invention.

EXAMPLE

Seven pilot delayed coking runs were performed using as the coker feedstock a vacuum reduced residuum having the following properties:

| 940+° F. Vacuum Resid | |
|---|---|
| Gravity, °API | 9.4 |
| Molecular Weight | 810 |
| Con. Carbon, wt. % | 18.90 |
| Elemental Analysis, wt. % | |
| Carbon | 85.16 |
| Hydrogen | 10.62 |
| Sulfur | 1.99 |
| Nitrogen | 0.54 |
| Trace Metals, ppm | |
| Nickel | 29 |
| Iron | 35 |
| Vanadium | 75 |
| C5 Insolubles, wt. % | 10.80 |
| Ash, wt. % | 0.07 |
| ASTM Distillation, °F. | |
| IBP | 893 |
| 5 vol. % | 961 |
| 10 vol. % | 989 |

Table 1 shows the variables used in the seven delayed coker tests. Each test was run under typical coking conditions of 860° F. average drum temperature and 40 psig drum pressure, and followed standard operating procedures. Tests No. 1–3 are baseline (no sludge) tests. Tests No. 4–7 investigate sludge concentration and method of addition.

The petroleum sludge employed had the following typical composition and properties:

| Petroleum Sludge | |
|---|---|
| Composition, wt. % | |

-continued

| Petroleum Sludge | |
|---|---|
| Oil | 15.5 |
| Water | 25.0 |
| Solids | 59.5 |
| Trace Metals, ppm dry basis | |
| Chromium | 886 |
| Lead | 276 |
| Vanadium | 367 |
| Total sludge density, gm./cc | 1.09 |
| GC Distribution (oil only), °F. | |
| IBP/5 wt. % | 192/283 |
| 10/20 | 329/381 |
| 30/40 | 418/453 |
| 50/60 | 492/547 |
| 70/80 | 623/714 |
| 90/95 | 813/882 |
| EP | 992 |

TABLE 1

DELAYED COKER SLUDGE ADDITION TESTING TEST PROGRAM

| Test No. | Sludge Addition | Location/Time | Wt. % on Feed | Run Length (hrs) | Coke Yield (wt. %) | Overall Recovery (wt. %) |
|---|---|---|---|---|---|---|
| 1 | No | — | — | 14[1] | 23.67 | 97.40 |
| 2 | No | — | — | 6 | 25.74 | 95.02 |
| 3 | No | — | — | 6 | 25.06 | 94.67 |
| 4 | Yes | With Quench/ End of Run | 0.21 | 6 | 23.46 | 95.31 |
| 5 | Yes | Before Htr. Coil/During Run | 0.93 | 6 | 24.36 | 96.54 |
| 6 | Yes | Before Htr. Coil/During Run | 0.92 | 6 | 24.41 | 100.92 |
| 7 | Yes | Feed Can/ During Run | 1.85 | 6 | 26.48 | 98.93 |
| | | | | Average[2] | 24.92 | 96.90 |

[1]Feed rate: 450gm./hr. All other tests @ 900 gm./hr.
[2]6 hour runs only

To determine the effect of sludge addition on coke properties, the green coke from Tests No. 3–7 was removed from the drum and separated into three sections (top, middle and bottom). Each section was then submitted for the standard set of coke analyses. The analytical results from these samples are listed in Table 2 by test number and sample location. Comparing the volatile matter, ash content, and Hardgrove Grindability Index results from each section of the no-sludge run (Test No. 3) with that from the corresponding section of the highest sludge addition run (Test No. 7), it appears that there is no significant effect of sludge addition on green coke properties. It further appears that the green coke product is very suitable for use in making a calcined coke product.

TABLE 2

DELAYED COKER SLUDGE ADDITION TESTING COKE ANALYSES

| Test No. | Ni (ppm) | V (ppm) | S (wt %) | VM (wt %) | Ash (wt %) | HGI |
|---|---|---|---|---|---|---|
| | | | Top | | | |
| 1 | | ← (one blended sample) → | | | | |
| 2 | | ← (one blended sample) → | | | | |
| 3 | 130 | 230 | 2.87 | 17.41 | 0.17 | 117 |
| 4 | 120 | 220 | 2.87 | 13.24 | 0.00 | 127 |
| 5 | 140 | 200 | 3.01 | 21.26 | 0.06 | 120 |
| 6 | 140 | 210 | 2.92 | 17.19 | 0.08 | 110 |
| 7 | 150 | 300 | 2.94 | 28.12 | 0.11 | 116 |
| | | | Middle | | | |
| 1 | 430 | 370 | 2.81 | 12.06 | 0.52 | 76 |
| 2 | 570 | 290 | 2.70 | 22.74 | 0.52 | 97 |
| 3 | 200 | 330 | 2.75 | 22.44 | 0.39 | 85 |
| 4 | 220 | 320 | 2.80 | 13.80 | 0.22 | 115 |
| 5 | 310 | 340 | 2.82 | 22.48 | 0.40 | 120 |
| 6 | 190 | 330 | 2.84 | 19.40 | 0.28 | 91 |
| 7 | 200 | 200 | 2.82 | 24.52 | 0.30 | 93 |
| | | | Bottom | | | |
| 1 | | ← (one blended sample) → | | | | |
| 2 | | ← (one blended sample) → | | | | |
| 3 | 420 | 350 | 2.70 | 25.37 | 0.73 | 61 |
| 4 | 580 | 410 | 2.80 | 15.16 | 0.86 | 106 |
| 5 | 670 | 350 | 2.82 | 23.50 | 0.72 | 82 |
| 6 | 290 | 370 | 2.76 | 27.65 | 0.92 | 77 |
| 7 | 360 | 330 | 2.68 | 21.87 | 0.64 | 87 |

Notes
VM = Volatile Matter (wt. %) from Proximate Analysis test
HGI = Hardgrove Grindability Index - a measure of relative hardness

What is claimed is:

1. In a process for producing delayed petroleum coke comprising introducing a liquid hydrocarbon coker feedstock into a delayed coking drum under delayed coking conditions to produce delayed coke therein, the improvement comprising adding petroleum sludge to said coker feedstock and subjecting said petroleum sludge and coker feedstock to the delayed coking conditions in the coking drum before quenching.

2. The process of claim 1 wherein said petroleum sludge is added to said coker feedstock prior to introduction to the coking drum.

3. The process of claim 2 wherein from about 0.01 to 2 percent petroleum sludge by weight of said coker feedstock is added to said coker feedstock.

* * * * *